US006435694B1

(12) United States Patent
Bell et al.

(10) Patent No.: US 6,435,694 B1
(45) Date of Patent: Aug. 20, 2002

(54) CANDLE WITH INSERT

(75) Inventors: Jeffrey Bell, Bloomsbury; Stuart A. Zlotnik, Montville, both of NJ (US)

(73) Assignee: Aromatic Technologies, Inc., Somerville, NJ (US)

( * ) Notice: Subject to any disclaimer, the term of this patent is extended or adjusted under 35 U.S.C. 154(b) by 0 days.

(21) Appl. No.: 09/918,087

(22) Filed: Jul. 30, 2001

Related U.S. Application Data

(63) Continuation of application No. 09/329,702, filed on Jun. 10, 1999, now abandoned.

(51) Int. Cl.[7] ..... F21L 19/00; F21V 35/00
(52) U.S. Cl. ..... 362/161; 362/163; 431/291
(58) Field of Search ..... 362/161, 182, 362/173; 431/291, 289, 34, 35, 126

(56) References Cited

U.S. PATENT DOCUMENTS

| | | | |
|---|---|---|---|
| 1,485,810 | A | 3/1924 | Parker, Jr. et al. |
| D111,775 | S | 10/1938 | Seaver |
| D115,947 | S | 8/1939 | Wilson |
| 2,584,563 | A | 2/1952 | Duncan |
| 2,817,225 | A | 12/1957 | Weglin |
| 2,988,284 | A | 6/1961 | Smith |
| 3,254,512 | A | 6/1966 | Prentice |
| 3,434,789 | A | 3/1969 | Haller |
| 3,615,289 | A | 10/1971 | Felton |
| 3,630,697 | A | 12/1971 | Dulling et al. |
| 3,645,705 | A | 2/1972 | Miller et al. |
| 3,741,711 | A | 6/1973 | Bryant |
| 3,753,643 | A | 8/1973 | Golden |

(List continued on next page.)

FOREIGN PATENT DOCUMENTS

| | | |
|---|---|---|
| DE | 004016007 A | 11/1991 |
| EP | 224389 | 6/1987 |
| JP | 1221-494 A | 2/1988 |
| WO | WO 88/00603 | 1/1988 |
| WO | WO 97/08282 | 3/1997 |

OTHER PUBLICATIONS

Sales tag from "Clearfire De–Lite" candle product (from "Candle–lite –a Lancaster Colony Company", Cincinnati, OH 45242) (1995).

(List continued on next page.)

*Primary Examiner*—Stephen Husar
*Assistant Examiner*—Ali Alavi
(74) *Attorney, Agent, or Firm*—Reed Smith LLP

(57) ABSTRACT

A new and improved candle with a novel structure and novel decorative features. The candle has a composite structure, including an outer portion and an inner portion. The outer portion in a preferred embodiment is made of a gel composition. In preferred embodiments, the outer portion may be set in an outer receptacle or stand alone. The outer portion of the candle has a recess into which the inner portion is positioned. The inner portion typically contains at least one wick. In a preferred embodiment, the inner portion may be contained in an inner receptacle, which is then placed into the recess in the outer portion of the candle. In a preferred embodiment, the inner receptacle is clear, and, even more preferably, is concealed by the outer portion. In another preferred embodiment, the inner receptacle or the inner portions, or both, are replaceable. The inner portion may be formed from wax or gel or other suitable candle body material. In preferred embodiments, the outer portion may contain a variety of decorative objects or may be designed to produce a variety of decorative effects. In a preferred embodiment, the decorative effect imparted by the candle takes advantage of the visual effect of having an inner and outer portion. Fire retardant may be included in the outer or inner portion of the candle as a safety measure. When a wick in the inner portion is lit, light from the inner portion passes through the outer portion of the candle and enhance decorative effects dispersed in the outer candle body.

32 Claims, 2 Drawing Sheets

U.S. PATENT DOCUMENTS

| | | | | |
|---|---|---|---|---|
| 3,761,702 | A | | 9/1973 | Ardeweg |
| 3,771,445 | A | | 11/1973 | Campbell et al. |
| 3,790,332 | A | | 2/1974 | Woolard |
| D231,135 | S | | 4/1974 | Marcum |
| 3,819,342 | A | | 6/1974 | Gunderman et al. |
| 3,898,039 | A | | 8/1975 | Lin |
| 3,947,232 | A | | 3/1976 | Foster |
| 4,017,729 | A | | 4/1977 | Frazier, Jr. |
| 4,035,138 | A | | 7/1977 | Walters |
| 4,110,066 | A | | 8/1978 | Murphy |
| 4,110,261 | A | | 8/1978 | Newland |
| 4,225,552 | A | | 9/1980 | Chang |
| 4,332,548 | A | | 6/1982 | Linton |
| 4,369,284 | A | | 1/1983 | Chen |
| 4,409,275 | A | * | 10/1983 | Samowich ..... 428/138 |
| 4,449,987 | A | | 5/1984 | Lindauer |
| 4,528,227 | A | | 7/1985 | Frechtmann |
| 4,568,270 | A | | 2/1986 | Marcus et al. |
| 4,587,129 | A | | 5/1986 | Kliment |
| D290,208 | S | | 6/1987 | Hlava et al. |
| 4,826,428 | A | | 5/1989 | Lam |
| 4,855,098 | A | | 8/1989 | Taylor |
| 5,127,922 | A | | 7/1992 | Bension |
| 5,132,355 | A | | 7/1992 | Nahlovsky |
| 5,171,329 | A | | 12/1992 | Lin |
| 5,221,534 | A | | 6/1993 | DesLauriers et al. |
| 5,395,233 | A | | 3/1995 | Karp |
| D371,713 | S | | 7/1996 | Credle |
| 5,578,089 | A | | 11/1996 | Elsamaloty |
| 5,605,765 | A | | 2/1997 | Rudick |
| 5,632,615 | A | | 5/1997 | DeGarmo |
| D380,417 | S | | 7/1997 | Hurdy |
| 5,660,281 | A | | 8/1997 | James |
| D387,446 | S | | 12/1997 | Bell et al. |
| 5,833,874 | A | | 11/1998 | Stewart et al. |
| 5,871,765 | A | | 2/1999 | Johnson et al. |
| 5,879,694 | A | * | 3/1999 | Morrison et al. ..... 424/405 |
| 5,891,400 | A | | 4/1999 | Ansari et al. |
| D411,891 | S | | 7/1999 | Bell et al. |
| 6,059,564 | A | * | 5/2000 | Morris ..... 431/291 |
| 6,071,506 | A | | 6/2000 | Semoff et al. |
| 6,111,055 | A | | 8/2000 | Berger et al. |

OTHER PUBLICATIONS

Pourette Candle and Soap Making Supplies Catalog, Pourette Mfg. Co., Seattle, WA.

Emkay Candle Wonderland, Item #605 Christmas Toddy Mug, p. 5 (Mar. 1968).

American Candle Co. Inc., #WS–299 Beer Stein Lite–S-cented (Aug. 1966).

Monongah Glass Co., #5247, Saucer Champagne, p. 113 (Apr. 1920).

Monongah Glass Co., #7806 Confction Stand, p. 257 (Apr. 1920).

Monongah Glass Co., #8902 Tmbler, p. 172 (Apr. 1920).

Marble Technics, Ltd. Adv. Flyer, Marble Pattern A, top left side of page, copy in D5/44.

Marble Technics, Ltd. Adv. Brochure, Final Review, Marble Pattern B, copy in D5/44.

Gift and Tableware Report, Serendipity Design scented candles, p. 17, Mar. 1969.

* cited by examiner

CANDLE WITH INSERT

This application is a continuation application of Ser. No. 09/329,702 filed Jun. 10, 1999, now abandoned.

FIELD OF THE INVENTION

The present invention relates generally to candles. The invention relates more particularly to decorative candles.

BACKGROUND OF THE INVENTION

Candles are desired for both their functional and aesthetic characteristics. In addition to providing light and creating a pleasant atmosphere when lit, candles can impart pleasing decorative and fragrant effects as ornamental objects even when they are not lit. The functional and decorative potentials of candles often have been constrained by the particular properties of conventional wax (including beeswax, paraffin and tallow) candle bodies. The conventional candle structure, a wick longitudinally disposed through a cylindrical candle body, also has certain shortcomings.

The life of a conventional candle is inherently limited due to the consumption of the candle body as the candle burns. The amount of time for which a conventional candle is usable is predetermined by the size of the candle and the properties of the candle body formulation together with the wick. Eventually, the entire candle may be consumed, or a substantial portion may be consumed such that the candle becomes unsafe to burn or no longer imparts the desired aesthetic effect. Even after only one use, the aesthetic impression of a conventional candle may be significantly altered. Moreover, conventional candles may cause heat damage to surfaces on which they rest as they are consumed when the flame burns close to the bottom of the candle.

Decorative effects applied on the surface of the conventional candle or interspersed through the candle body must be non-flammable and relatively inexpensive, as the decorations will also be consumed, deformed, or displaced as the candle burns. Also, the opaque quality of even colorless wax candle bodies limits the versatility of candle designs and decorative effects that can be applied. Decorative effects available for conventional candles often emphasize surface decoration of the candle body.

The use of a gel candle body has the potential to overcome these structural, aesthetic and functional problems of prior art candles.

Innovations for candle devices have been disclosed in the prior art for specific purposes. A variety of candles have features that permit extended use or have novel decorative effects. Nevertheless, the present invention provides numerous advantages, including that its decorative effect may be altered by replacement of one portion, that it may be reused after the wick has been completely consumed, and that it allows for an expanded range of three-dimensional, or multi-layered decorative effects.

U.S. Pat. No. 3,741,711 to Bryant discloses a decorative indefinitely reusable wax candle with surface ornamentation and coloration only. The candle is provided with a small cylindrical candle that is inserted in a transparent cup set in the candle body. The small cylindrical candle may be replaced periodically after it is used up. The decorative features of the candle are limited to its exterior surface.

U.S. Pat. No. 5,632,615 to DeGarmo discloses a cookie cutter candle, with a cylindrical wax body, and exterior wax layer, that has ornamentation in its exterior wax layer. Cookie cutter-type cut-outs in the outer wax layer are inlaid with colored wax plugs to create multi-colored images on the surface of the candle body. The decorative features of this candle also are limited to its exterior surface.

U.S. Pat. No. 5,578,089 to Elsamoloty discloses a candle made from a gel. The gel candle body is clear, and may be colored or scented. U.S. Pat. No. 5,578,089 is hereby incorporated herein by reference.

U.S. application Ser. No. 08/927,985, having a common assignee with the present invention, discloses a candle body from a gel composition The gel candle body is clear and may be colored, scented, given a pearlized appearance, or decorated with embedded objects. U.S. application Ser. No. 08/927,985 is hereby incorporated herein by reference.

U.S. application Ser. No. 29/064,005, having a common assignee with the present invention, discloses a gel candle with a pearl-like appearance. U.S. application Ser. No. 29/064,005 is hereby incorporated herein by reference.

There is an advantage in a candle that has an inner portion that may be replaceable and allows for alteration of its aesthetic impression, use beyond the life of a conventional candle, and application of three-dimensional and other decorative effects.

SUMMARY OF THE INVENTION

The invention comprises a candle with a novel structure and novel decorative features. The candle has a composite structure, including an outer portion and an inner portion. The outer portion in a preferred embodiment is made of a gel composition. In preferred embodiments, the outer portion may be set in an outer receptacle or stand alone. In preferred embodiments, the outer receptacle may be clear.

The outer portion of the candle has a recess into which the inner portion is positioned. The inner portion typically contains at least one wick. In a preferred embodiment, the inner portion may be contained in an inner receptacle, which is then placed into the recess in the outer portion of the candle. In a preferred embodiment, the inner receptacle is clear, and, even more preferably, is concealed by the outer portion. In another preferred embodiment, the inner receptacle or the inner portions, or both, are replaceable. The inner portion may be formed from wax or gel or other suitable candle body material. In a preferred embodiment, the inner portion is formed from a pearlized gel composition. The inner portion or, preferably, the outer portion, or both, also may contain flame retardant.

In preferred embodiments, the outer portion may contain a variety of decorative objects or may be designed to produce a variety of decorative effects. In a preferred embodiment, the decorative effect imparted by the candle takes advantage of the visual effect of having an inner and outer portion. When a wick in the inner portion is lit, light from the inner portion passes through the outer portion and enhances decorative effects dispersed in the outer candle body.

One advantage of the present invention is to provide a candle that may be reused after the wick portion has been consumed.

Further, it is an advantage of the invention to provide a candle with a gel outer portion.

It is also an advantage of the invention to provide a candle with a replaceable inner portion (or with a replaceable inner receptacle).

It is another advantage of the invention to provide a candle in which the aesthetic impression or effect may be changed.

Additionally, it is an advantage of the invention to provide a candle with a replaceable inner portion that is either a gel, a wax, oil candle, or other type of candle and that may be replaced by either a gel, a wax, an oil or other type of candle.

Furthermore, it is an advantage of the invention to provide a candle with decoration dispersed through the candle, or the outer body, and not limited to the exterior surface of the candle.

Also, it is an advantage of the invention to provide a candle with three-dimensional decorative effects.

It is another advantage of the invention to provide a candle that allows for multi-layered decorative compositions.

Moreover, it is also an advantage of the invention to provide a candle that has unique light dispersion and shadow effects.

It is also an advantage of the invention to provide a candle with decorative effects using articles that may be heat-sensitive, and unsuitable for use in a conventional candle.

It is another advantage of the present invention to provide a candle that will not cause heat damage to surfaces on which it rests.

It is also an advantage of the present invention to provide a candle that can extinguish the flame if the candle is in an unsafe position.

Further, it is an advantage of the present invention to provide a candle that will preserve its original ornamental appearance despite, or enhanced by, the use of the candle.

It is an advantage of the invention to provide a candle comprising an inner portion and an outer portion, and giving the appearance of a single unit.

Other details, objects and advantages of the present invention will become apparent as the following description of the presently preferred embodiments and presently preferred methods of practicing the invention proceeds.

BRIEF DESCRIPTION OF THE DRAWINGS

The present invention and its presently preferred embodiments will be better understood by way of reference to the detailed disclosure herebelow and to the accompanying drawings, wherein.

DETAILED DESCRIPTION OF THE DRAWINGS

Figure 1:
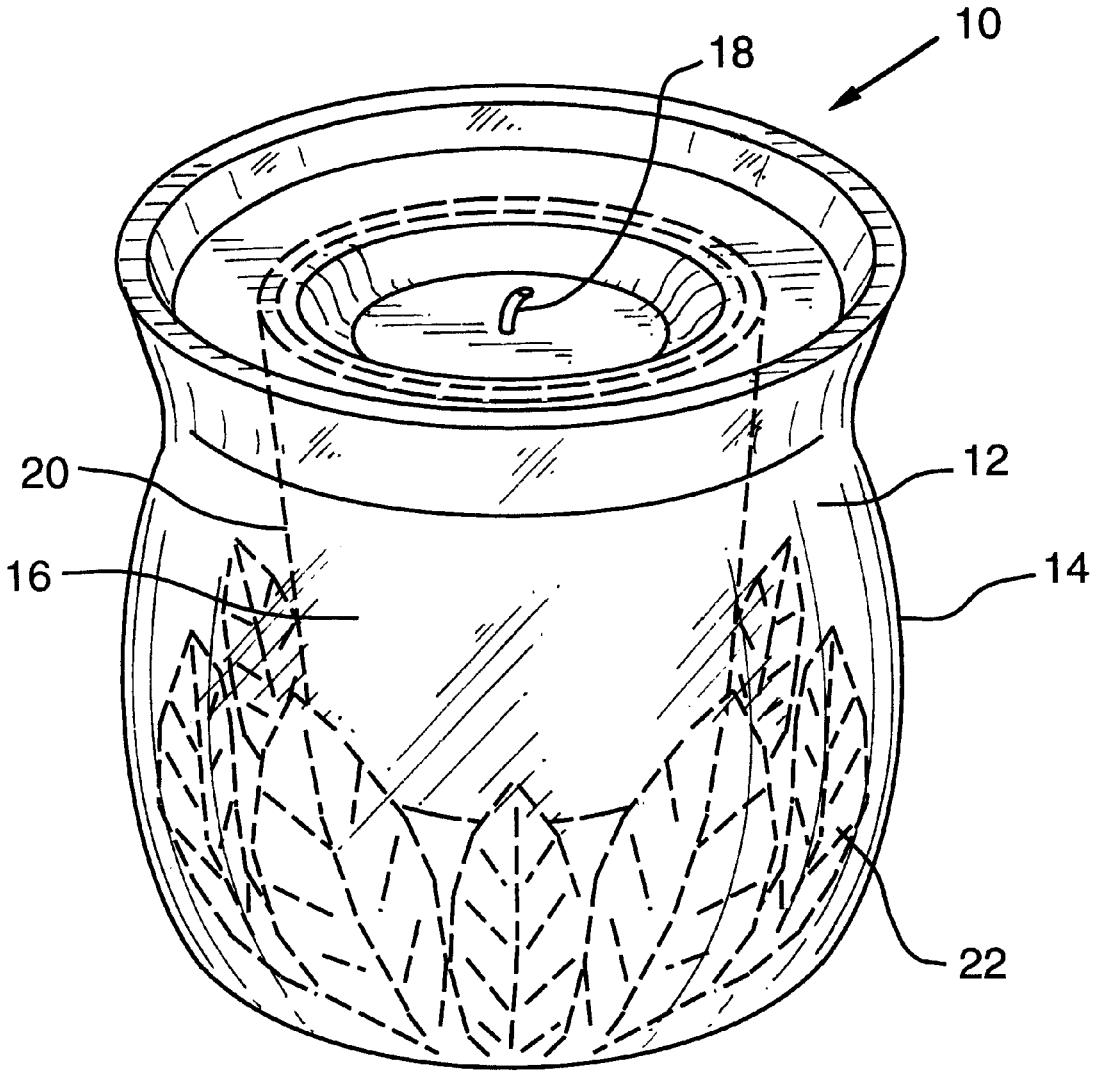
FIG. 1 is a perspective view of a preferred embodiment of a candle with insert in accordance with the present invention.
Figure 2:
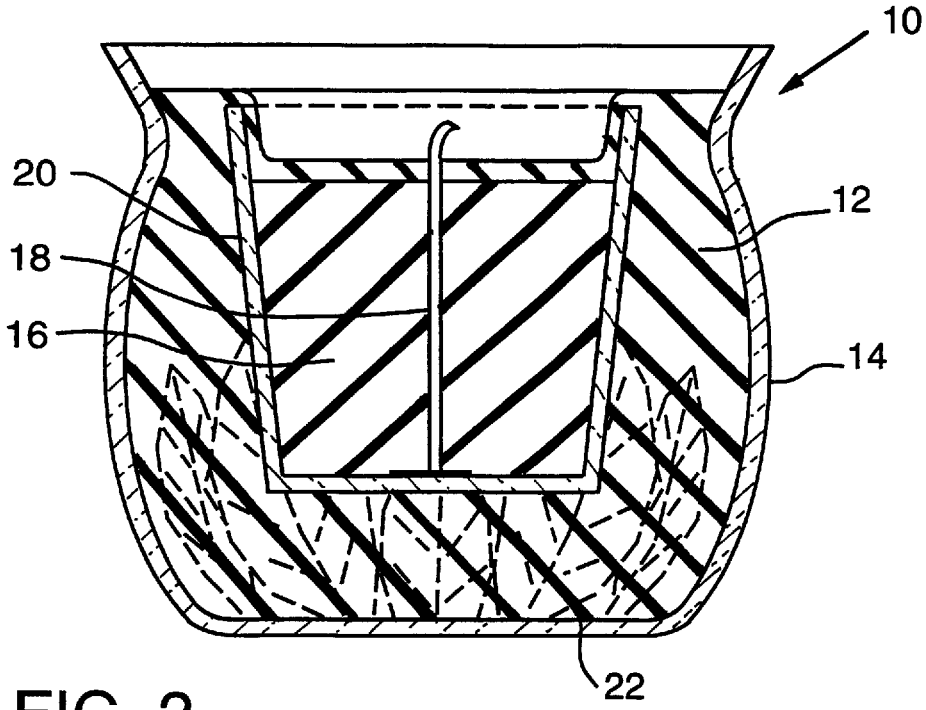
FIG. 2 is a cross-section of the embodiment of FIG. 1 taken along line III of FIG. 3.
Figure 3:
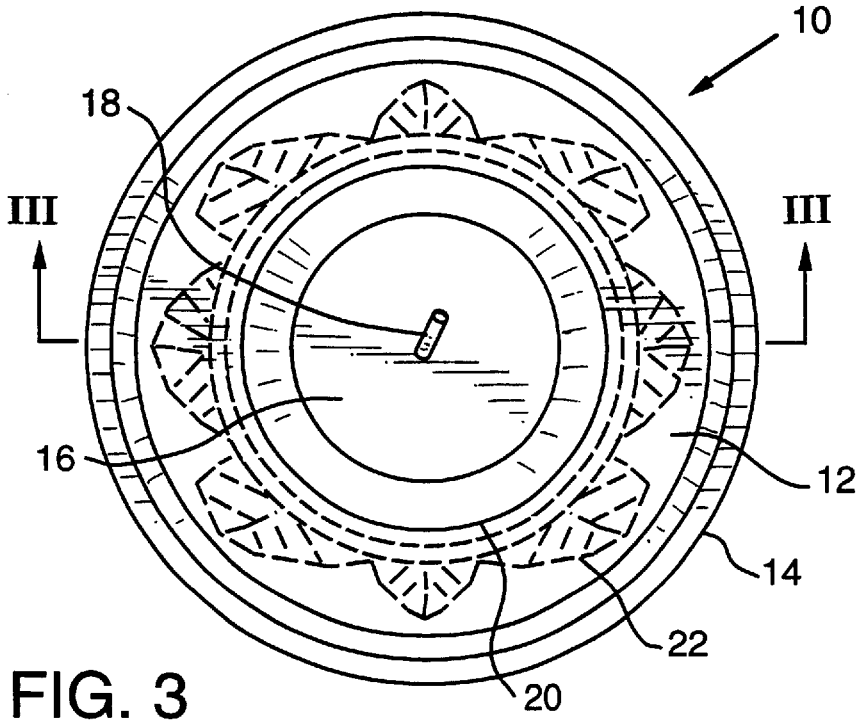
FIG. 3 is a top elevation view of the embodiment of FIG. 1.

Referring initially to FIGS. 1 and 2, there is generally indicated at 10 a candle including an outer portion 12 that is disposed in an outer receptacle 14, and an inner portion 16, with a wick 18, that is disposed in an inner receptacle 20. The outer portion 12 may contain a variety of decorative objects or effects 22.

The outer portion 12 is formed from a gel candle body composition, preferably as described in U.S. application Ser. No. 08/927,985. The gel composition of the outer portion is preferably non-opaque and allows both light to transfer through the outer portion 12 and decorative objects 22 to be seen from the exterior of the candle.

In a preferred embodiment, the gel is chemically stable, does not flash, does not separate, does not exhibit syneresis, remains clear over extended periods of time, and does not coke during burning. The outer portion 12 is preferably either transparent or translucent, but may be colored or decorated or both.

The outer portion 12 is preferably colored and decorated with decorative objects 22 embedded therein. The decorative objects 22 are not limited to those that are not heat-sensitive. They could, for example, include silk leaves, giving the impression of a flower to the combination of the leaves with a colored inner portion 16. The decorative objects 22 may also take advantage of the unique light transmitting properties of the gel outer portion 12. Other objects suitable for use as decorative objects 22 include, but are not limited to, crystals, stones, and glitter. The invention exploits the ability of the candle to allow for three-dimensional decorative effects and multi-layered decorative effects.

In the illustrated embodiment, the outer portion 12 includes a recess that substantially conforms to the shape and size of the inner receptacle 20. The recess is preferably deep enough to allow the top of the inner receptacle 20 to be flush with or slightly below the top of the outer portion 12. This permits gel from the outer portion 12 to overflow the rim of the inner receptacle 20 to make the inner receptacle 20 appear invisible, if desired.

The outer portion 12 may optionally contain a fire retardant, which may be useful, for example, when potentially flammable objects are embedded in the outer portion 12 and/or when no physical barrier is provided between the outer portion 12 and the inner portion 16. The fire retardant may prevent flammable material embedded in the gel from igniting. Also, the fire retardant may provide an additional safety feature. If a lighted candle is inadvertently knocked on its side, sufficient gel containing fire retardant may run into the candle pool from the outer portion 12 to extinguish the flame.

Any suitable fire retardant may be used. Fire retardants that may be useful include, but are not limited to, striazine compounds, halogenated compounds, antimonies, heavy metal compounds and phosphorus compounds. A preferred fire retardant is Antiblaze® N, a cyclic phosphonate ester sold by Albright and Wilson. In preferred embodiments, the composition of the outer portion 12 includes between about 2 and about 5 percent by weight of Antiblaze® N. Fire retardant could also optionally be included in the bottom portion of the inner portion 16 of the candle 10 to extinguish the flame when it burns closer to the bottom of the candle 10.

The outer receptacle 14 that typically contains the outer portion 12 is preferably made of a heat-safe material, preferably glass, that also allows for light transfer through the outer receptacle 14. The outer receptacle 14 may have any shape, although a rounded cylindrical shape is shown in FIGS. 1 and 2. The outer receptacle 14 may be decorated, for example, etched or colored, as well.

The inner receptacle 20 is set into the recess in the outer candle body and may be removable and replaceable. If included, the inner receptacle 20 may have any shape but should be able to fit within the perimeters of the outer receptacle 14 to a desired depth. The inner receptacle 18 should also have a shape that allows the inner portion 16 to be removed easily from the outer portion 12 and replaced with a new inner receptacle without damage to the outer portion 12. The inner receptacle 20 preferably fits deep enough within the outer portion 12 so that it is flush with or slightly below the top of the outer portion 12. The outer portion 12 may cover the rim of the inner receptacle 20 so that it is concealed from view. The inner receptacle 20 may be decorated, for example, etched or colored, as well.

In the illustrated embodiment, the inner portion 16 rests in the inner receptacle 20 and may be removable from the inner receptacle 20 and replaceable. This permits changes in the desired color, scent, or appearance of the inner portion 16. The wick 18 in the inner portion 16 may be lit. When the wick 18 burns, the inner portion 16 is consumed. The inner portion 16 may be either wax, including paraffin, beeswax or tallow, gel, or oil, or any other type of candle but is preferably a pearlized gel. Either the inner portion 16 or the inner receptacle 20, or both, may be removable and replaceable. They may be removed and replaced when the inner portion 16 or wick 18 are used up or when a different aesthetic impression is desired.

If not otherwise stated herein, it may be assumed that all components and/or processes described heretofore may, if appropriate, be considered to be interchangeable with similar components and/or processes, unless an express indication is made to the contrary.

Terminology used herein is for the purpose of description and not for the purpose of limitation. Although the invention has been described in detail for the purpose of illustration, it is to be understood that such detail is solely for that purpose and that numerous modifications, alterations and changes can be made therein by those skilled in the art without departing from the spirit and scope of the invention except as it may be limited by the claims. All changes which come within the meaning and range of equivalency of the claims are to be embraced within their scope.

What is claimed is:

1. A candle comprising:

an outer portion formed from a gel, wherein at least one decorative object is embedded in said outer portion and substantially surrounded by said gel;

an inner portion disposed at least partially within said outer portion; and a wick disposed in said inner portion.

2. The candle of claim 1, wherein said inner portion is replaceable.

3. The candle of claim 1, wherein said outer portion is substantially nonvolatile.

4. The candle of claim 2, wherein said inner portion is formed from gel.

5. The candle of claim 4, wherein said gel inner portion is pearlized.

6. The candle of claim 2, wherein said inner portion is formed from wax.

7. The candle of claim 2, wherein a three-dimensional decorative effect is disposed in said outer portion.

8. The candle of claim 2, wherein a multi-layered decorative effect is disposed in said outer portion.

9. The candle of claim 2, further comprising an inner receptacle, wherein said inner portion is disposed at least partially in said inner receptacle, and said inner receptacle is contained at least partially within said outer portion.

10. The candle of claim 9, wherein said inner receptacle is replaceable.

11. The candle of claim 1, further comprising an inner receptacle, wherein said inner portion is disposed at least partially in said inner receptacle, and said inner receptacle is at least partially disposed within said outer portion.

12. The candle of claim 11, wherein said inner receptacle is replaceable.

13. The candle of claim 11, wherein said inner receptacle is made of glass.

14. The candle of claim 11, wherein said outer portion is substantially nonvolatile.

15. The candle of claim 1, wherein said at least one decorative object is a floral simulation.

16. The candle of claim 11, wherein said inner portion is formed from gel.

17. The candle of claim 11, wherein said inner portion is formed from wax.

18. The candle of claim 11, wherein said inner portion is formed from oil.

19. The candle of claim 16, wherein said gel inner portion is pearlized.

20. The candle of claim 11, wherein a three-dimensional decorative effect is disposed in said outer portion.

21. The candle of claim 11, wherein a multi-layered decorative effect is disposed in said outer portion.

22. The candle of claim 11, wherein said outer portion overflows said inner receptacle, making it appear substantially invisible.

23. The candle of claim 1, further comprising an outer receptacle, wherein said outer portion is at least partially disposed in said outer receptacle.

24. The candle of claim 23, wherein said outer receptacle is not opaque.

25. The candle of claim 23, wherein said outer portion is substantially nonvolatile.

26. The candle of claim 1, wherein the outer portion of the candle contains fire retardant.

27. The candle of claim 2, wherein the outer portion of the candle contains fire retardant.

28. The candle of claim 9, wherein the outer portion of the candle contains fire retardant.

29. The candle of claim 11, wherein the outer portion of the candle contains fire retardant.

30. The candle of claim 23, wherein the outer portion of the candle contains fire retardant.

31. The candle of claim 26, wherein said fire retardant is capable of extinguishing the flame if the candle is oriented dangerously.

32. The candle of claim 26, wherein said fire retardant is selected from the group consisting of striazine compounds, halogenated compounds, antimonies, heavy metal compounds, and phosphorus compounds.

* * * * *